US011060423B2

(12) United States Patent
Leroux et al.

(10) Patent No.: US 11,060,423 B2
(45) Date of Patent: Jul. 13, 2021

(54) CLOSED CIRCUIT FUNCTIONING ACCORDING TO A RANKINE CYCLE WITH A DEVICE FOR THE EMERGENCY STOPPING OF THE CIRCUIT, AND METHOD USING SUCH A CIRCUIT

(71) Applicants: IFP Energies nouvelles, Rueil-Malmaison (FR); ENOGIA, Marseilles (FR)

(72) Inventors: Arthur Leroux, Marseilles (FR); Antonin Pauchet, Marseilles (FR)

(73) Assignees: IFP Energies nouvelles, Rueil-Malmaison (FR); ENOGIA, Marseilles (FR)

( * ) Notice: Subject to any disclaimer, the term of this patent is extended or adjusted under 35 U.S.C. 154(b) by 0 days.

(21) Appl. No.: 16/325,484

(22) PCT Filed: Jul. 11, 2017

(86) PCT No.: PCT/EP2017/067352
§ 371 (c)(1),
(2) Date: Feb. 14, 2019

(87) PCT Pub. No.: WO2018/033303
PCT Pub. Date: Feb. 22, 2018

(65) Prior Publication Data

US 2019/0186299 A1 Jun. 20, 2019

(30) Foreign Application Priority Data

Aug. 18, 2016 (FR) ..... 16/57.808

(51) Int. Cl.
*F01K 13/02* (2006.01)
*F01K 13/00* (2006.01)
(Continued)

(52) U.S. Cl.
CPC ..... *F01K 13/025* (2013.01); *F01D 21/00* (2013.01); *F01D 25/08* (2013.01); *F01K 13/00* (2013.01);
(Continued)

(58) Field of Classification Search
CPC ..... F01K 23/065
See application file for complete search history.

(56) References Cited

U.S. PATENT DOCUMENTS 3,292,372 A * 12/1966 Michel ..... F01K 3/22 60/656
3,563,035 A * 2/1971 Raymond ..... B60K 3/00 60/657
(Continued)

FOREIGN PATENT DOCUMENTS

FR 2884555 A1 10/2006
JP 2001-033004 A 1/2001
JP 2008-008217 A 1/2008

OTHER PUBLICATIONS

International Search Report for PCT/EP2017/067352, dated Sep. 21, 2017; English translation submitted herewith (5 pgs.).
(Continued)

*Primary Examiner* — Laert Dounis
(74) *Attorney, Agent, or Firm* — Fitch, Even, Tabin & Flannery, LLP

(57) ABSTRACT

The present invention relates to a closed circuit operating on a Rankine cycle, the circuit comprising at least one compression and circulation pump for a working fluid in liquid form, a heat exchanger over which a hot source is swept in order to evaporate the fluid, means for expanding the fluid in the form of a vapor, a cooling exchanger swept by a cold source to condense the working fluid, a reservoir of working fluid, and working fluid circulation pipes for circulating the
(Continued)

Figure 1:
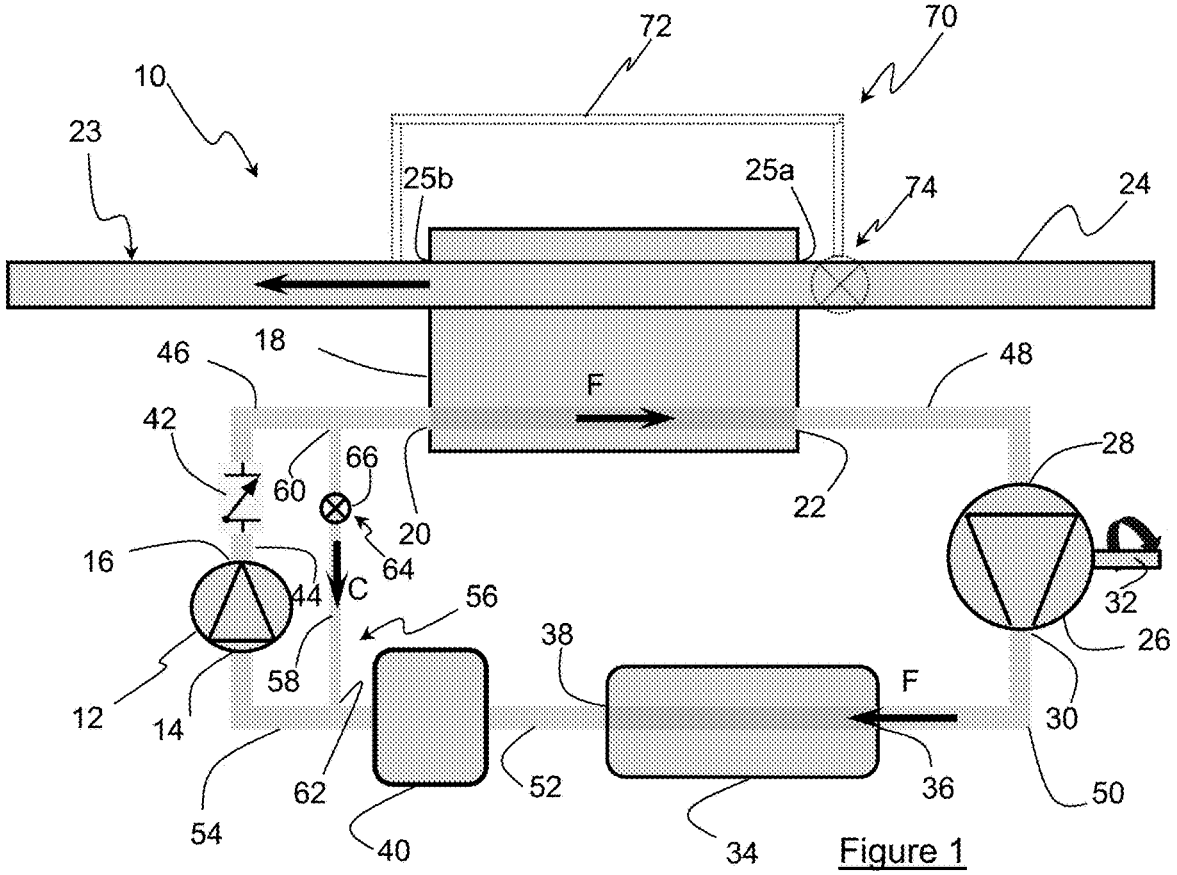

fluid between the pump, the heat exchanger, the expansion means, the condenser and the reservoir.
The circuit comprises a device for draining the fluid contained in the heat exchanger.

7 Claims, 1 Drawing Sheet

(51) Int. Cl.
*F01D 21/00* (2006.01)
*F01D 25/08* (2006.01)
*F22B 37/02* (2006.01)
*F22B 37/50* (2006.01)

(52) U.S. Cl.
CPC ..... *F01K 13/02* (2013.01); *F05D 2210/10* (2013.01); *F05D 2220/31* (2013.01); *F22B 37/02* (2013.01); *F22B 37/50* (2013.01)

(56) References Cited

U.S. PATENT DOCUMENTS 3,747,333 A * 7/1973 Gerstmann ..... F01K 13/006 60/670
3,955,358 A * 5/1976 Martz ..... F01K 13/02 60/39.182
4,177,767 A * 12/1979 Regamey ..... F01K 9/023 122/1 R
4,406,127 A * 9/1983 Dunn ..... F02G 5/02 60/321
6,237,542 B1 5/2001 Nakajo et al.
10,138,759 B2 * 11/2018 Leduc ..... F01K 25/10
2011/0041505 A1 * 2/2011 Kasuya ..... F02G 5/02 60/660
2011/0192178 A1 8/2011 Ternel et al.
2014/0075934 A1 3/2014 Rewers et al.
2015/0013338 A1 * 1/2015 Smague ..... F01N 5/02 60/645
2018/0353873 A1 * 12/2018 Goldshtein ..... F01K 23/10

OTHER PUBLICATIONS

Office Action dated Mar. 29, 2021 in counterpart KR Appln. No. 10-2019-7005053.

Office action dated Mar. 23, 2021 in counterpart JP Appln. No. 2019-509496.

* cited by examiner

CLOSED CIRCUIT FUNCTIONING ACCORDING TO A RANKINE CYCLE WITH A DEVICE FOR THE EMERGENCY STOPPING OF THE CIRCUIT, AND METHOD USING SUCH A CIRCUIT

CROSS-REFERENCE TO RELATED APPLICATIONS

This application is a U.S. national phase application filed under 35 U.S.C. § 371 of International Application No. PCT/EP2017/067352, filed Jul. 11, 2017, designating the United States, which claims priority from French Patent application Ser. No. 16/57,808, filed Aug. 18, 2016, which are hereby incorporated herein by reference in their entirety.

The present invention relates to a closed circuit operating on a Rankine cycle, with an emergency shutdown device for shutting down this circuit and to a method using a circuit with such a device.

As is widely known, the Rankine cycle is a thermodynamic cycle by means of which heat from an external heat source is transmitted to a closed circuit containing a working fluid. During the course of the cycle, the working fluid undergoes changes in phase (liquid/vapor).

This type of cycle can generally be broken down into a step during which the working fluid used in liquid form undergoes isentropic compression, followed by a step during which this compressed liquid fluid is heated and vaporized upon contact with a heat source.

This vapor is then expanded, during another step, in an expansion machine and then, in a final step, this expanded vapor is cooled and condensed upon contact with a cold source.

In order to perform these various steps, the circuit comprises at least one pump—compressor for circulating and compressing the fluid in liquid form, an evaporator over which a hot fluid is swept in order to at least partially vaporize the compressed fluid, an expansion machine for expanding the vapor, such as a turbine, which converts the energy of this vapor into another form of energy, such as mechanical or electrical energy, and a condenser by means of which the heat contained in the vapor is released to a cold source, generally external air, or alternatively a circuit of cooling water which is swept over this condenser in order to convert this vapor into a fluid in liquid form.

In this type of circuit, the fluid used is generally water, although other types of fluid, for example organic fluid or mixtures of organic fluids, can also be used. The cycle is then referred to as an Organic Rankine Cycle or ORC.

By way of example, the working fluids may be butane, ethanol, hydrofluorocarbons, ammonia, carbon dioxide, etc.

As is well known, the hot fluid for vaporizing the compressed fluid may come from varying hot sources, such as a coolant (from a combustion engine, from an industrial process, from a furnace, etc.), hot gases resulting from combustion (flu gases of an industrial process, from a boiler, exhaust gases from a combustion engine or a turbine, etc.), from a flow of heat derived from thermal solar collectors, etc.

More particularly, it is known practice, notably from document FR 2 884 555, to use the calorific energy carried by the exhaust gases of an internal combustion engine, particularly that used for motor vehicles, as a hot source for heating and vaporizing the fluid passing through the evaporator.

That makes it possible to improve the energy efficiency of this engine by recuperating a large proportion of the energy lost in the exhaust and converting it into energy that can be used for the motor vehicle through the Rankine cycle circuit.

The Rankine cycle circuit thus makes it possible to improve the efficiency of the engine.

In this type of circuit, if a problem arises, either externally to the closed circuit or within the same, it may prove necessary to perform an emergency shutdown on the circuit in order to prevent it from producing any more energy.

In order to do this, it is usual practice to use one or two bypasses with bypass valves, one making it possible to bypass the hot fluid inlet into the evaporator and the other bypassing the passage of the vaporized working fluid through the expansion machine.

The use of a configuration in which the evaporator is simply bypassed has a disadvantage.

Specifically, given the thermal inertia of the circuit and notably that of the evaporator, the presence of working fluid in the liquid state in at least part of this evaporator, or further on in the circuit, leads to the production of vapor for a further few tens of seconds still, after the emergency stop has been activated.

Further, the presence of pressurized working-fluid vapor upstream of the expansion machine persists.

It is not therefore possible to achieve a rapid (which means to say in a few seconds) halt to the production of energy on the output side of the expansion machine.

The second valve then allows working-fluid vapor present upstream of the expansion machine to be diverted directly to the downstream side of this machine. Because the expansion machine is thus bypassed, the circuit is no longer capable of producing energy and energy production is rapidly halted.

However, this second valve is situated in a branch of the circuit in which the working fluid is at once under pressure, hot, and in gaseous form. It therefore needs to be selected accordingly, in materials that are resistant to temperature and to pressure and have a size, notably in terms of its bore section, suited to allowing the passage of streams of vapor in the event of its being actuated.

The present invention proposes to overcome the above disadvantages by proposing a closed circuit with a device that makes it possible, in the event of an emergency shutdown of this circuit, to avoid an influx of vaporized working fluid in the inlet of the expansion machine.

To this end, the invention relates to a closed circuit operating on a Rankine cycle, said circuit comprising at least one compression and circulation pump with an inlet and an outlet for a working fluid in liquid form, a heat exchanger over which a hot source is swept in order to evaporate said fluid circulating between an inlet and an outlet of said heat exchanger, means for expanding the fluid in the form of a vapor, a cooling exchanger swept by a cold source to condense the working fluid circulating between an inlet and an outlet of said cooling exchanger, a reservoir of working fluid, and working fluid circulation pipes for circulating said fluid between the pump, the heat exchanger, the expansion means, the condenser and the reservoir, characterized in that the circuit comprises a device for draining the fluid contained in the heat exchanger.

The draining device may comprise a drain pipe connected to two connecting points of the circuit and bearing a directional-control means.

The directional-control means may be a two-way valve placed on the pipe between the two connecting points.

The directional-control means may be a three-way valve placed on one of the points of connection to the circuit.

The directional-control means may be an electrically operated valve.

One of the connecting points may be positioned between the pump and the heat exchanger and the other of the connecting points may be positioned between the cooling exchanger and the pump.

The circuit may comprise a bypass device for the hot source which passes through the heat exchanger.

The invention also relates to a method for controlling a closed circuit operating on a Rankine cycle, said circuit comprising at least one compression and circulation pump with an inlet and an outlet for a working fluid in liquid form, a heat exchanger over which a hot source is swept in order to evaporate said fluid circulating between an inlet and an outlet of said heat exchanger, means for expanding the fluid in the form of a vapor, a cooling exchanger swept by a cold source to condense the working fluid circulating between an inlet and an outlet of said cooling exchanger, a reservoir of working fluid, and working fluid circulation pipes for circulating said fluid between the pump, the heat exchanger, the expansion means, the condenser and the reservoir, characterized in that in the event of an emergency shutdown of the circuit, the fluid contained in the heat exchanger is transferred to the part of the circuit between the upstream side of the pump and the reservoir.

The fluid contained in the heat exchanger can be transferred toward the reservoir.

The fluid contained in the heat exchanger can be transferred toward the pipe connecting the upstream side of the pump and the reservoir.

The circulation of the working fluid in the drain pipe can be controlled by a directional-control means.

Circulation of the hot source can be subjected to a bypass so that this flow bypasses the heat exchanger.

Figure 2:
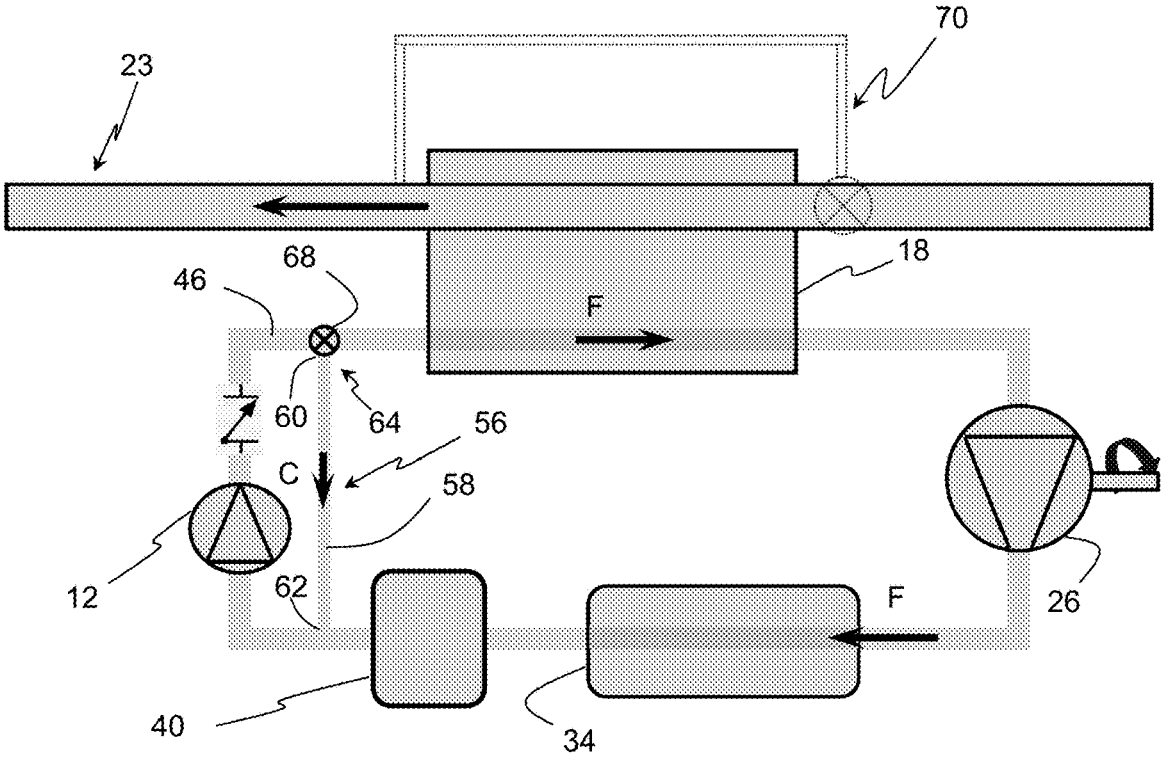

The other features and advantages of the invention will become apparent from reading the following description, given solely by way of nonlimiting illustration, and to which are attached:

FIG. 1 which illustrates a closed circuit operating on a Rankine cycle according to the invention and FIG. 2 which illustrates an alternative form of the closed circuit operating on a Rankine cycle according to FIG. 1.

FIGS. 1 and 2 illustrate one embodiment of a closed circuit Rankine cycle 10 which is advantageously of the ORC (Organic Rankine Cycle) type and which uses an organic working fluid or mixtures of organic fluids such as butane, ethanol, hydrofluorocarbons, etc.

Of course the closed circuit may also operate on a fluid such as ammonia, water, carbon dioxide, etc.

This circuit comprises a pump 12 for compressing and circulating the working fluid, referred to in the remainder of the description as the circulation pump, with an inlet 14 for working fluid in liquid form and an outlet 16 for this working fluid, likewise in liquid form, but compressed to a high pressure. This pump is advantageously rotationally driven by any means, such as an electric motor (not depicted).

This circuit also comprises a heat exchanger 18, referred to as evaporator, through which the compressed working fluid passes between an inlet 20 for this liquid fluid and an outlet 22 through which the working fluid re-emerges from this evaporator in the form of compressed vapor. This evaporator also has passing through it a hot source 23 in liquid or gaseous form, carried by a line 24 between an inlet 25*a* and an outlet 25*b* so that it can release its heat to the working fluid.

This hot source may for example stem from the exhaust gases of an internal combustion engine, from the engine coolant of an internal combustion engine, from the cooling fluid of an industrial furnace, or from the heat-transfer fluid heated up in thermal installations or by a burner.

This circuit also comprises an expansion machine 26 which via its inlet 28 receives the working fluid in the form of a high-pressure compressed vapor, this fluid reemerging via the outlet 30 of this machine in the form of low-pressure expanded vapor.

Advantageously, this expansion machine takes the form of an expansion turbine the rotor shaft of which is rotationally driven by the working fluid in vapor form, by causing a connecting shaft 32 to rotate. For preference, this shaft allows the energy recuperated from the working fluid to be transmitted to any conversion device, such as, for example, an electric generator (not depicted).

The circuit further comprises a cooling exchanger 34, or condenser, with an inlet 36 for the expanded low-pressure vapor and an outlet 38 for the low-pressure working fluid converted into liquid form after passing through this condenser.

This condenser is swept by a cold source, generally a flow of ambient air or of cooling water, so as to cool the expanded vapor so that it condenses and is converted into a liquid.

Of course, any other cooling cold source, such as another cooling liquid or cold air, can be used to cause the vapor to condense.

This circuit also comprises, between the condenser and the circulating pump, a closed reservoir 40 for keeping the working fluid in the liquid state.

Advantageously, the circuit comprises a nonreturn check-valve 42 placed in the vicinity of the outlet 16 from the pump 12, and a filter (not depicted), such as a cartridge filter, for filtering the working fluid leaving the reservoir before it enters the pump.

Of course, the various elements of the circuit are connected to one another by fluid circulation pipes 44, 46, 48, 50, 52, 54, successively connecting the pump to the check-valve (check-valve pipe 44), the check-valve to the evaporator (evaporator pipe 46), the evaporator to the turbine (turbine pipe 48), this turbine to the condenser (condenser pipe 50), the condenser to the reservoir (reservoir pipe 52), the reservoir to the pump (pump pipe 54) so that the working fluid circulates in a clockwise direction as indicated in the figures by the arrows F.

This circuit further comprises a draining device 56 for draining the fluid contained in the heat exchanger 18 and which, in the event of a circuit emergency shutdown, allows the pressurized liquid contained in this exchanger to be transferred to the reservoir or to that part of the circuit that is situated between this reservoir and the upstream side of the pump.

By way of example illustrated in the figure, this draining device 56 comprises a drain pipe 58, which starts at a connecting point 60 of the circuit upstream of the evaporator and downstream of the pump (when considering the direction in which the working fluid circulates according to the arrows F) on the pipe or 46 where the fluid is in liquid form and ends at another connecting point 62 of this circuit upstream of the pump and downstream of the condenser on one of the pipes 52 or 54 where the fluid is likewise in liquid form.

More specifically, and as better illustrated in the figures, this pipe starts at a point 60 of the circuit between the nonreturn check-valve 42 and the inlet 20 of the evaporator and ends at a point 62 on the circuit positioned between the outlet of the reservoir 40 and the inlet 14 of the pump 12.

In the example of the figures, a directional-control means 64 makes it possible to control the circulation of the working fluid in liquid form that circulates in this pipe.

This directional-control means is a two-way valve 66 in the case of FIG. 1 and is situated on the pipe 58 some distance from the two connecting points.

As illustrated in FIG. 2, the directional-control means 64 is a three-way valve 68 which is positioned on the point 60 of connection to the pipe 46.

These two types of valve can be controlled by any known means, such as electrical, pneumatic, hydraulic, etc. means.

Advantageously, these valves can also be electrically-operated valves, in particular electrically-operated solenoid valves.

Thus, this drain pipe and the valve that controls its actuation, are subjected only to a moderate temperature. The choice of materials for this valve is therefore less restrictive.

In addition, the fact that the draining device 56 is designed to pass working fluid in the liquid state between the pipes 46 and 62 means that recourse can be had to a valve that is smaller in size than in the usual circuit designs, thereby making it possible to reduce the cost and bulk thereof.

Advantageously, although this is not compulsory, a bypass device 70 for the hot source 24 which passes through the evaporator 18 (bypass illustrated in dotted line in the figures) may be positioned in the path of this source so that it bypasses this evaporator. By way of example, this device comprises a pipeline 72 bypassing the evaporator and situated between the hot-source inlet 25*a* to the evaporator and its outlet 25*b*. This pipeline bears a directional-control means 74, in this instance a three-way valve, which is placed on the line 24 upstream of the evaporator and at the junction with the pipeline 72 thus making it possible to control the circulation of the hot source through this bypass pipeline.

Of course, like the directional-control means 64, this valve may be controlled by any known means, such as electrical, pneumatic, hydraulic, etc. means.

In the event of the emergency shutdown procedure being activated, the circuit control unit, that any closed circuit habitually has, proceeds to shut down the pump 12. During this emergency shutdown the draining device 56 is activated by commanding the directional-control means 64 to open so that the working fluid circulates in the pipe 58 in the direction indicated by the arrow C. This then makes it possible to drain the fluid contained in the evaporator 18 toward that part of the circuit (in this instance the branch 54) situated between the pump and the reservoir so that this fluid is then introduced into this reservoir.

Additionally, this control unit activates the evaporator bypass device 70 by commanding the valve 74 into a position such that the hot source bypasses the evaporator.

Thus, under the effect of the pressure of the working fluid present in the evaporator 18 and in the pipes 46 and 48 between the outlet 16 of the pump 12 (and its nonreturn check-valve 42) and the inlet 28 of the turbine 26, the opening of the valve of the draining device causes a large proportion of the working fluid, present in the evaporator in liquid state, to flow back toward the reservoir through the pipe 58.

This is notably achieved thanks to the presence of the check-valve 42 which prevents the working fluid from circulating towards the outlet side of the pump.

Thus deprived of a good proportion of its supply of working fluid, vapor production within the evaporator quickly disappears. The turbine is in turn deprived of a supply of gaseous working fluid and energy production by the circuit quickly comes to a halt.

It should be noted that this emergency shutdown procedure can be brought into action through various means, such as detection of a circuit malfunction (overpressure, overheating, etc.), manual shutdown, etc.

The invention claimed is:

1. A method for controlling a closed circuit operating on a Rankine cycle, the circuit comprising at least one compression and circulation pump with an inlet and an outlet for a working fluid in liquid form, a heat exchanger over which a hot source is swept in order to evaporate the fluid circulating between an inlet and an outlet of the heat exchanger, an expansion device for expanding the fluid in the form of a vapor, a cooling exchanger swept by a cold source to condense the working fluid circulating between an inlet and an outlet of the cooling exchanger, a reservoir of working fluid, working fluid circulation pipes for circulating the fluid between the pump, the heat exchanger, the expansion means, the condenser and the reservoir, a bypass device for the hot source which passes through the heat exchanger, the bypass device comprising a bypass pipeline connected between an upstream line for carrying the hot source to the heat exchanger and a downstream line for carrying the hot source from the heat exchanger, the bypass device bypassing the heat exchanger, the bypass pipeline bearing a three-way valve provided at a junction of the pipeline with the upstream line of the heat exchanger, and a nonreturn check-valve placed in a vicinity of the outlet of the at least one compression and circulation pump, the method comprising, upon occurrence of an emergency shutdown of the circuit initiated by detection of at least one of overpressure and overheating, transferring the fluid contained in the heat exchanger to the part of the circuit between the upstream side of the pump and the reservoir, and commanding the three-way valve into a position such that the hot source bypasses the heat exchanger through the bypass pipeline.

2. The method as claimed in claim 1, wherein, upon the occurrence of the emergency shutdown of the circuit, the fluid contained in the heat exchanger is transferred toward the reservoir.

3. The method as claimed in claim 1, wherein, upon the occurrence of the emergency shutdown of the circuit, the fluid contained in the heat exchanger is transferred toward a pipe connecting the upstream side of the pump and the reservoir through a drain pipe.

4. The method as claimed in claim 3, wherein the circulation of the working fluid in the drain pipe is controlled by a directional-control means.

5. The method as claimed in claim 1, wherein the hot source swept over the heat exchanger comprises exhaust gas of an internal combustion engine, engine coolant of an internal combustion engine or cooling fluid of an industrial furnace.

6. The method as claimed in claim 1, wherein, upon the occurrence of the emergency shutdown, a circuit control unit shuts down the at least one compression and circulation pump and activates transfer of the fluid contained in the heat exchanger to the part of the circuit between the upstream side of the pump and the reservoir.

7. The method as claimed in claim 1, wherein, upon the occurrence of the emergency shutdown, a circuit control unit shuts down the at least one compression and circulation pump, activates transfer of the fluid contained in the heat exchanger to the part of the circuit between the upstream side of the pump and the reservoir, and activates bypass flow of the hot source so that it bypasses the heat exchanger.

* * * * *